United States Patent [19]

Taylor

[11] Patent Number: 4,781,062

[45] Date of Patent: Nov. 1, 1988

[54] CONJUGATE FRACTURE SYSTEMS AND FORMATION STRESSES IN SUBTERRANEAN FORMATIONS

[75] Inventor: Thompson J. Taylor, Tulsa, Okla.

[73] Assignee: Amoco Corporation, Chicago, Ill.

[21] Appl. No.: 112,961

[22] Filed: Oct. 23, 1987

[51] Int. Cl.[4] ..... E21B 49/00

[52] U.S. Cl. ..... 73/152; 33/303; 364/422

[58] Field of Search ..... 73/784, 151, 152; 33/302, 303; 364/422

[56] References Cited

U.S. PATENT DOCUMENTS 4,044,828 8/1977 Jones et al. ..... 73/784 X
4,698,911 10/1987 Rambow ..... 33/302

OTHER PUBLICATIONS

Friedman, M. Structural Analysis . . . California, Am. Assoc. of Pet. Geologists Bulletin, vol. 53, No. 2, Feb. '69, pp. 367–389.

Zemanek, J. et al., Formation Evaluation . . . Televiewer, Geophysics, vol. 35, No. 2, Apr. '70, pp. 254–269.

Broding, R. A. Volumetric Scanning . . . Borehole, World Oil, Jun. 1982, pp. 100–104.

Broding, R. A. Application of . . . Cement Evaluation, SPWLA 25th Logging Symposium, Jun. 10–13, '84, pp. 1–17.

Wiley, R. Borehole Televiewer–Revisited, SPWLA 21st Logging Symposium, Jul. 8–11, '80, pp. 1–16.

Taylor, T. J. Interpretation and . . . Surveys, SPWLA 24th Logging Symposium, Jun. 27–30, '83, pp. 1–19.

*Primary Examiner*—Jerry W. Myracle

[57] ABSTRACT

Subterranean fault-related facture systems are located and identified and the direction of action of paleostresses causing the fault-related fracture system can be determined from a record representative of depth, dip angle, and dip direction of subterranean generally planar formation features intersecting a borehole and from information relating to borehole diameter, dip angle, and dip direction.

11 Claims, 4 Drawing Sheets

θ = 25°

θ = 90°

CONJUGATE FRACTURE SYSTEMS AND FORMATION STRESSES IN SUBTERRANEAN FORMATIONS

FIELD OF THE INVENTION

The invention relates to a method for identifying in a subterranean formation conjugate fracture systems, fault-related or nonfault-related, and further for determining the direction of action of the formation or paleostresses which caused the conjugate fracture systems. In a particular aspect, the invention relates to such a method using records produced from borehole pulse-echo acoustic logging. In a further aspect, the invention relates to such a method in which a synthetic record is produced which is representative of depth, dip angle, and dip direction of fractures belonging to a conjugate fracture system and bedding planes intersecting a borehole.

SETTING OF THE INVENTION

A fracture is a discontinuity along a plane (fracture plane) which at some point in the past has been a plane of no cohesion. A fault is a fracture or fracture zone resulting from a deformational episode during which there has been displacement of the sides relative to one another along, that is, parallel to the fracture. Fracture systems and especially faults and resulting fault-related fracture systems play an essential role in the migration and entrapment of petroleum in many reservoirs as conduits for petroleum migration, as trap generators, and as permeability barriers.

In evaluating reservoirs having conjugate fracture systems, it would be desirable to identify the local stresses originally producing the conjugate fracture system, herein referred to as the formation (or paleo-) stress(es). Then with the knowledge of the existing orientation of the fracture system, migration and trapping can be investigated. Further, in the case of established fracture systems, a knowledge of the paleostresses can permit prediction of sites for future exploration and development and can facilitate design of fracture treatments for production of oil and gas.

A determination of the paleostresses existing in a subterranean formation at the time of fracturing, including faulting, provides valuable information in the development of fracture treatments for production of a reservoir. Particularly if the existing stresses are in the same or substantially the same orientation as the paleostresses, many production problems in the design of fracturing treatments can be significantly simplified. Thus, one approach would be to design the fracture treatment so that the minimum principal stress as determined from the paleostresses is enhanced during the fracture treatments. Further, such paleostress information can provide structural information on a whole region, and is not inherently restricted to a localized area.

Further, once a conjugate fracture system is identified in the subsurface, the drilling of a well can be deviated so as to penetrate the maximum number of fractures. Further, in the case of fault-related fracture systems, valuable information on how to play a fault, that is, on the downthrown side or the upthrown side, and how to position wells to play the fault can be obtained.

Techniques are desirable which permit the determination of paleostresses in subterranean formations by examination of the in-situ borehole environment. Neither examination of exposed outcrops nor of oriented core nor use of dipmeter data present an adequate solution to this problem.

1. Determining Paleostresses From Outcrops and Oriented Core

Heretofore, knowledge of paleostresses producing a conjugate fracture system has been obtained by examination of exposed fracture systems (outcrops) and/or from microscopic fracture systems in oriented core. In such systems, conjugate fractures can be directly observed and because of the angular relationship of conjugate fractures relative to each other, it is possible to determine the direction of the principal stresses or loads at the time of formation of the conjugate fracture system (paleostresses).

Pertinent features of such determinations are:

1. The intersection of a fracture and of a conjugate fracture is parallel to and defines the orientation of $\sigma_2$.
2. The included acute angle between the planes of a fracture and of a conjugate fracture is bisected by $\sigma_1$.
3. $\sigma_3$ is 90° from each of $\sigma_1$ and $\sigma_2$, where $\sigma_1$ is the maximum principal stress, $\sigma_2$ is the intermediate principal stress, and $\sigma_3$ is the minimum principal stress.

Recognition of such conjugate fractures depends on being able to directly observe the conjugate fracture pattern and being able to directly observe and determine the included angle formed between conjugate fractures. Such fault-related patterns can be observed on all scales. See Friedman, 53 AAPG Bull. 367–389 (1969).

Techniques based on direct observation of conjugate fracture patterns and direct determination of included angles from examination of outcrops and oriented core are not, however, feasible for determining paleostresses in many subterranean formations. Outcrops must be somehow related by the investigator to subterranean structure to support an interpretation, and oriented core is frequently not available for investigation. Moreover, direct observation and direct determination of included angles characteristic of conjugate fracture patterns in situ is not feasible since the borehole cuts through or intersects the conjugate fracture system.

2. Determining Faults From Dipmeter Data

Conventionally, in inferring the presence of fractures which are also faults in the subsurface, dipmeters can be used to provide a measure of the dip angle and dip direction of sedimentary features such as bedding planes. The dipmeter measures the conductivity of the formation adjacent the borehole by three or more spaced apart electrodes. Correlations of conductivity can then be made to identify bedding planes having similar conductivity, and a measure of dip angle and dip direction can be made. Faults can be inferred from observation of the dip angles and dip directions of the bedding planes, but are seldom if ever directly detected.

The dipmeter becomes increasingly unreliable in fault related fracture zones where information must be obtained for determination of paleostresses. This is because of the inherent nature of the dipmeter tool which looks at resistivity similarities and dissimilarities to infer the existence of structure. When used in a fault related fracture zone and when all three or more tracks of a typical dipmeter are plotted, fractures can be identified, however, not reliably, and not all of the fractures will be identified. Further, when the borehole passes in close physical proximity to the fault, more fractures are typically observed. Accordingly, the dipmeter becomes increasingly unreliable the closer its proximity to the fault which is being investigated. Further, the rubble zone created by some faults can increase the difficulty in interpretation by making conductivity measurements noncorrelatable. Fractures can also become impregnated or filled with materials whose resistivity does not appreciably vary from that of the adjacent formation and this also can make fractures difficult to determine using dipmeters.

3. Investigation of Subterranean Structure Using Pulse-Echo Acoustic Logging Tools Pulse-echo logging tools such as the borehole televiewer can be used to produce a visual record of the subterranean structure traversed by a borehole and can be used to investigate subterranean structure. In this technology, pulses of acoustic energy from a transmitter in a logging sonde are utilized to radially sweep the surface of the borehole wall. Echoes (reflections of the acoustic pulses) from substantially perpendicular reflectors in the borehole surface are received by one or more receivers in the sonde and after appropriate processing sent to a display device such as a cathode ray oscilloscope or a television monitor or the like where an oriented visual record of the borehole wall can be displayed and/or recorded. From the oriented visual image, fractures and bedding planes can be observed and dip angle and dip direction of fractures and bedding planes can be determined. See Zemanek, Formation Evaluation by Inspection with the Borehole Televiewer, *Geophysics*, Volume 35, No. 2 (April 1970, pp. 254–269).

By measuring both amplitude and traveltime of the reflected acoustic pulses, both amplitude and traveltime-based records of the borehole wall structure can be produced and these amplitude and traveltime based images can be utilized to distinguish open from filled or partially filled fractures. (Cf. Broding, Volumetric Scanning Allows 3-D Viewing of the Borehole, World Oil, June 1982.) The televiewer images have also been used to determine induced fracture height and orientation, determine azimuth of hydraulically induced fractures, detect vugs and concretions, delineate laminated beds and changes in lithology, and evaluate dip meter measurements. (Cf. Wiley, Ralph, 1980, paper presented at SPWLA 21st Annual Logging Symposium, July 8–11, 1980; Taylor, T. J., Interpretation and Application of Borehole Televiewer Surveys, paper presented at SPWLA 24th Annual Logging Symposium, June 27–30, 1983.)

The borehole televiewer, moreover, is particularly effective in detecting fractures where the dipmeter is less effective. This is because the borehole televiewer image depends not on conductivity measurements which require good electrical contact, but on reflections of acoustic energy. Hence, good images can be produced of fracture zones due to differences in reflectivity precisely where reliable conductivity measurements are difficult to obtain.

Although the borehole televiewer has been used to determine dip angle and dip direction of fractures, the borehole televiewer is not believed heretofore to have been used for identification and characterization of conjugate fracture systems in situ along a borehole penetrating a subterranean formation. Such identification and characterization requires the discovery and recognition of how a conjugate fracture system would appear on a borehole televiewer record, and also the discovery and recognition of what steps can be taken to infer conjugate fracture systems in the subsurface from the borehole televiewer record.

It is desired to provide a method for locating conjugate fracture systems, both fault-related and nonfault-related, using borehole televiewer acoustic logging data. It is further desired to provide a method for determining directions of paleostresses of a conjugate fracture zone from measurements in situ in the borehole. It is further desired to determine directions of such stresses using borehole televiewer acoustic logging data thereby overcoming the limitations of dipmeters when used in fracture zones.

SUMMARY OF THE INVENTION

The invention comprises a method for identifying conjugate fracture systems in brittle or semi-brittle formation materials adjacent a borehole. The method comprises scanning a record representative of generally planar subsurface features intersecting a borehole, the record being representative of depth, dip angle, and dip direction of the generally planar subsurface features, and locating a set of fractures and deriving a measure of dip angle $\theta$ and dip direction $\phi$ for each fracture of the set producing a set of measures $(\theta,\phi)$; selecting a first subset and a second subset of fractures each subset characterized by a different $(\theta,\phi)$ and determining an indicator of whether the first subset and second subset fractures are conjugate by deriving a measure of one of the angles formed by intersection of a first subset fracture and a second subset fracture, that is, the included angle $\psi$ opposite the borehole or its supplementary angle.

In a further aspect, the invention comprises such a method wherein the set of fractures has about equal dip angles and comprises a first and second subset of fractures, the first and second subsets of fractures having dip directions about 180° apart relative to the borehole, wherein the sum of dip angles $\theta$ of a first subset fracture and of a second subset fracture is used as a measure of the included angle $\psi$.

According to a further aspect of the invention, the step of scanning includes a step of measuring dip angle and dip direction of the generally planar formation features intersecting a borehole; and the step of locating includes a step of selecting a set of generally planar formation structures which are representative of fractures. Then, from the thus selected set of fractures, first and second subsets of fractures conjugate to one another are identified in accordance with the invention.

According to a further aspect of the invention, the dip angles and dip directions of the first and second subsets of fractures conjugate to one another are compared with models of conjugate fracture systems and the first and second subsets of fractures conjugate to one another are assigned to an appropriate conjugate fracture system, for example, such a system selected from the groups of systems associated with normal faults and systems associated with reverse faults. Such information can then be used in exploring for and producing oil and gas.

According to a further aspect, the invention comprises a method for determining directions of paleostresses generating conjugate fracture systems in brittle or semi-brittle formation materials adjacent a borehole. According to this aspect, the method further includes the steps described above including identifying a conjugate fracture system. Then, the direction of action of one or more paleostresses selected from the group consisting of the maximum principal stress $\sigma_1$, the intermediate principal stress $\sigma_2$, and the minimum principal stress $\sigma_3$, is determined for the identified conjugate fracture system.

DEFINITIONS

Borehole Deviation—the divergence or deflection from the vertical of a borehole.

Borehole Deviation Direction—the horizontal angle relative to a specified coordinate direction, usually north, of borehole deviation; also referred to as azimuth of borehole deviation.

Dip Angle—the inclination from horizontal of the line on an inclined plane of greatest inclination from horizontal; perpendicular to strike; sometimes referred to as dip.

Dip Direction:—the horizontal angle relative to a specified coordinate direction, usually north, of the projection onto the horizontal plane of the line on an inclined plane of greatest inclination from horizontal; sometimes referred to as azimuth of dip.

Strike—the direction of an intersection of a structural surface, for example, a bedding or fracture plane, with the horizontal; perpendicular to dip angle.

Fracture—a discontinuity along a plane (fracture plane) which at some point in the past has been a plane of no cohesion.

Fault—a fracture plane along which significant displacement has occurred. A fault plane is a fracture plane characterized by differential movement of the upper and lower blocks on either side of the plane resulting from an applied stress.

Conjugate Fractures—a set of fractures related in age and origin; in particular, the at least two potentially developed shear fractures in any compressive state of stress formed at identical angles from the maximum principal stress direction.

Bedding Plane—in sedimentary or stratified rocks, the division plane that separates each successive layer or bed from the one above or below it, commonly characterized by a visible change in color or lithology.

Dip-Slip Faults—faults with displacement in the direction of the dip of the fault plane. Specifically, in a normal fault, the upper block moves down with respect to the lower block; and in a reverse fault (or thrust fault) the upper block moves upward with respect to the lower block.

Strike-Slip Fault—faults having displacement laterally along the strike of the fault plane; also called transcurrent, lateral, or wrench faults.

Oblique-Slip Fault—faults having movement along both the strike and dip of the fault plane.

Stress—force per unit area. By definition, any stress acting perpendicular to a surface along which the shear stress is zero is a principal stress. Paleostresses or formation stresses are stresses responsible for forming a fault-related fracture system. Principal paleostresses may be oriented parallel to x, y and z axes and may be designated $\sigma_1$, $\sigma_2$, and $\sigma_3$. If the relative intensities of the principal stresses are known, they may be termed the maximum (or greatest), intermediate, and minimum (or least) principal stresses.

Dihedral Angle—the acute angle formed between the maximum principal stress direction and a potential shear fracture. The angle is dependent on depth of burial, state of stress and the properties of the material.

DETAILED DESCRIPTION OF THE INVENTION

As indicated, a fracture is a discontinuity along a fracture plane which at some point in the past has been a plane of no cohesion. Fractures can be generated by applying stress to brittle or semi-brittle materials which are then observed to develop characteristic fracture systems comprising sets of fractures conjugate to one another. The sets of fractures conjugate to one another characteristically form an acute angle of about 50° therebetween under controlled conditions. Under natural conditions, the stresses are more complex, but nevertheless the included angles are usually observed to be in the range of about 40° to 60°, though angles outside this range have also been observed. Characteristically, all of the conjugate fractures of a system resulting from a set of stresses have about the same acute angle therebetween.

Figure 1A:
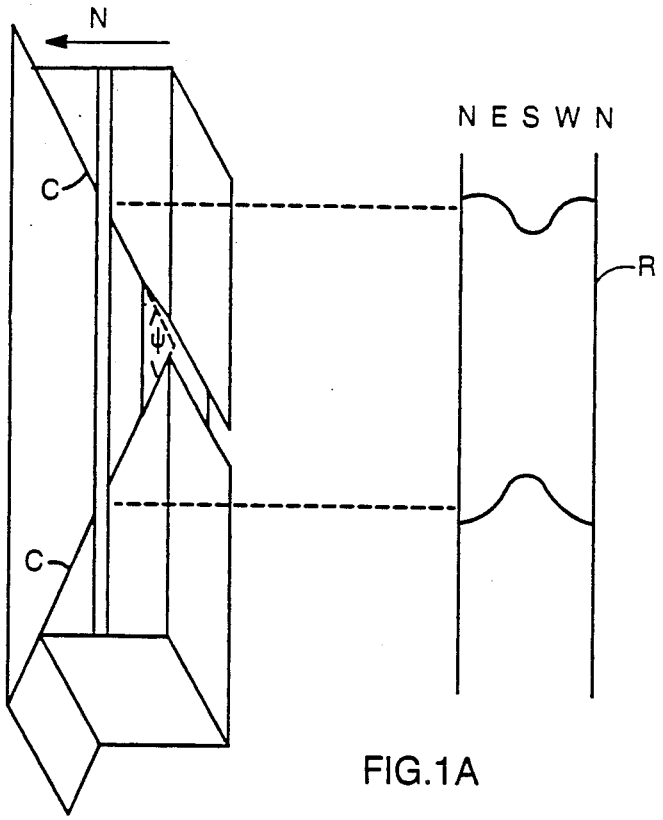
FIGS. 1A and 1B show the relationship between conjugate fractures of normal and reverse faults, respectively, to oriented records such as can be produced from pulse-echo acoustic logging.
Figure 1B:
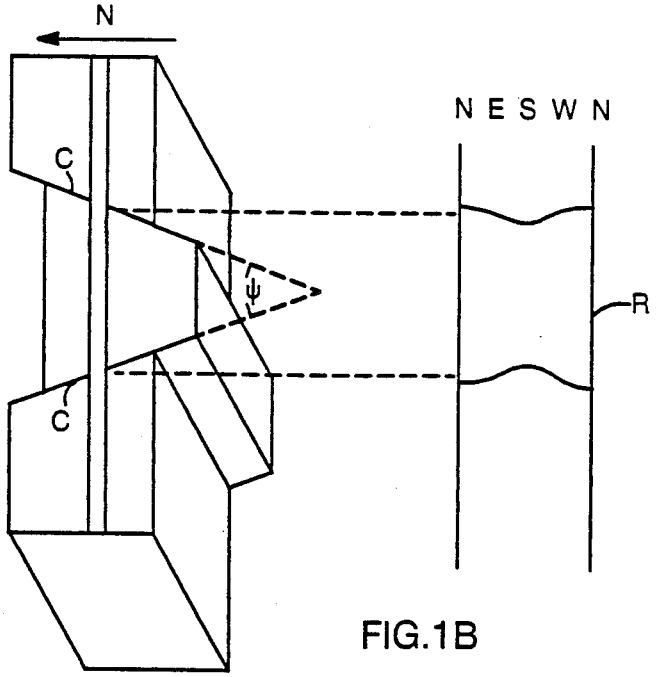

FIGS. 1A and 1B show the relationship between conjugate fractures C of normal (1A) and reverse (1B) faults to oriented records R which can be produced from pulse-echo acoustic (borehole televiewer) logging. Although the conjugate fracture systems shown in FIG. 1 are fault-related, the angles formed by extending the conjugate fractures intersecting the borehole until the fractures intersect one another are characteristic and illustrative also of nonfault-related fracture systems. The record R has a geographic orientation as indicated and is representative of the surface of borehole B penetrating the formations. The faults appear on the record R in the form of sinusoids. As illustrated, the dip angle of both conjugate fractures of the normal fault is about 65° (see FIG. 1A) and the dip angle of both conjugate fractures of the reverse fault is about 25° (see FIG. 1B). As illustrated, the borehole penetrates the fault-related fracture in a vertical direction and each conjugate fault has a dip direction (azimuth of dip) 180° out of phase with the other conjugate fault in both the normal and the reverse fault system.

As shown by the dashed lines, by extending the conjugate fractures until they intersect an included angle $\psi$ opposite the borehole is formed which is characteristically 130° for the normal fault system illustrated in FIG. 1A and characteristically 50° for the reverse fault system illustrated in FIG. 1B. The supplementary angles are 50° and 130°, respectively.

Figure 3A:
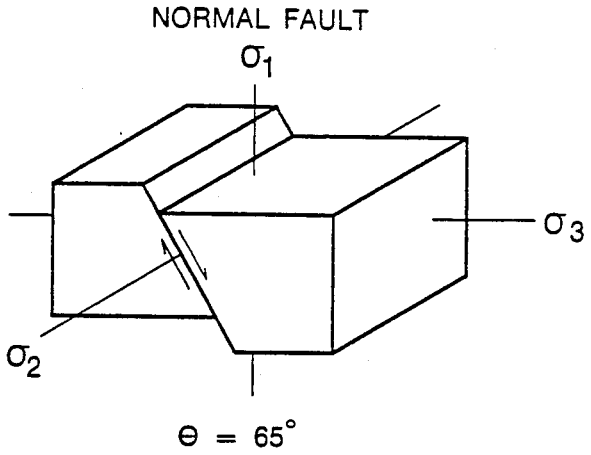
FIGS. 3A and 3B show the relationships of maximum, intermediate, and minimum principal stress directions to normal and reverse faults.
Figure 3B:
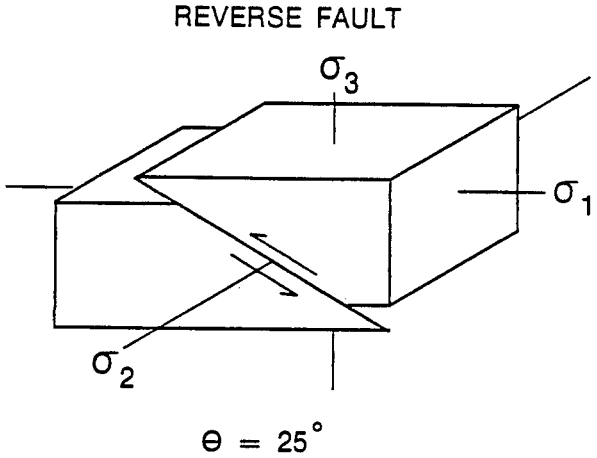

The symmetry of the dip angles and the 180° out-of-phase characteristic of the dip directions relative to the borehole is a result of the fact that the borehole is illustrated parallel to the maximum principal stress $\sigma_1$ direction in FIG. 1A and parallel to the minimum principal stress direction $\sigma_3$ in FIG. 1B (see also FIGS. 3A and 3B, respectively). This pattern is readily observed in nature (see Examples I and II).

Where the borehole is not parallel to the direction of action of one of the principal stresses, the borehole record of conjugate fractures will not be symmetrical as shown in FIGS. 1A and 1B. Rather, the apparent dip angles will not necessarily be equal, and the apparent dip directions will not necessarily be 180° apart (out-of-phase). Nevertheless, by determining a measure of the included angle opposite the borehole, or its supplement, formed by the intersection of fractures intersecting the borehole, it can be inferred whether the fractures are part of a conjugate fracture system and the directions of the paleostresses can be determined.

The technique in accordance with the invention can be used with both fault-related and nonfault-related conjugate fracture systems. A fault plane is a fracture plane characterized by differential movement of the upper and lower blocks on either side of the plane resulting from an applied stress. Thus, fault planes are by definition planes of shear. Associated with such fault planes are fault-related fractures, including conjugate fractures. According to the invention, therefore, there is also provided a method for identifying normal and reverse faults in the subsurface and for determining the direction of action of the paleostresses responsible for causing the fracture system associated with the fault.

Thus, if a conjugate fracture system can be identified and the fault plane, conjugate fractures, and the like can be identified, then the maximum, intermediate, and minimum principal stress directions can be determined. This is because a relationship exists between the initial failure surfaces (fractures) and the state of stress or elastic strain immediately preceding it. Thus, from a determination of the initial failure surfaces of the fault, something about the stress states and directions responsible for the formation of the failure can be ascertained.

Figure 2:
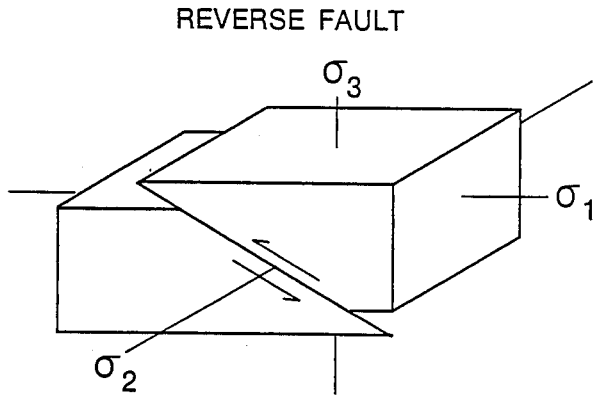
FIGS. 2A, 2B, 2C, 2D show the relationships between bedding planes and fractures on oriented records 2A produced by pulse-echo acoustic logging, on records of dip angle and dip direction 2B, oriented core 2C, and subterranean structure 2D.
Figure 2:
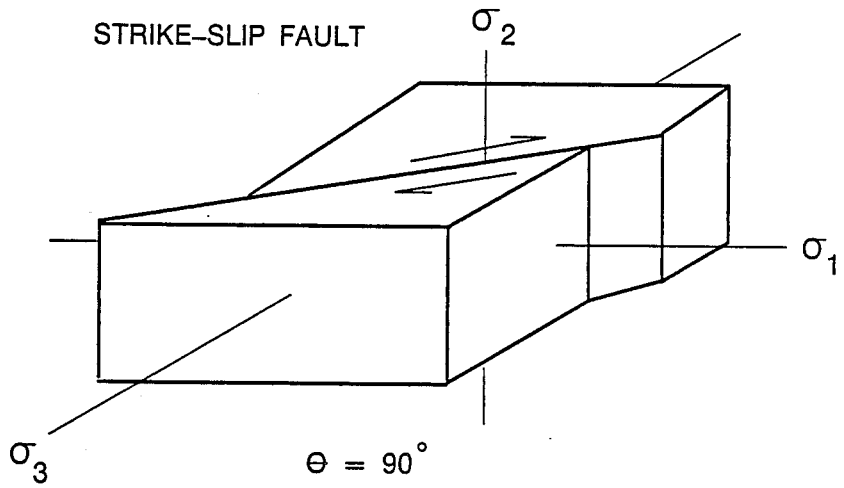
Figure 2D:
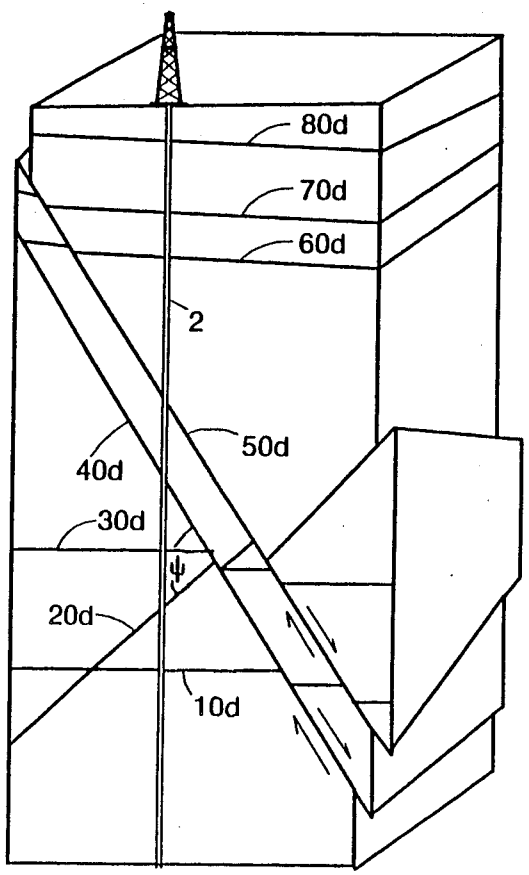
Figure 2C:
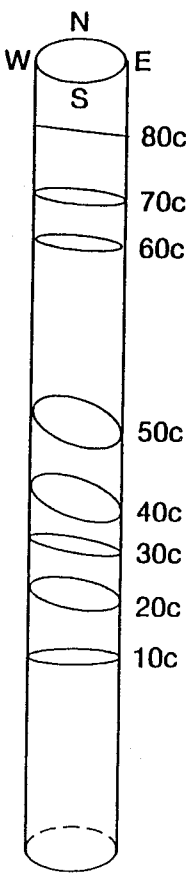
Figure 2B:
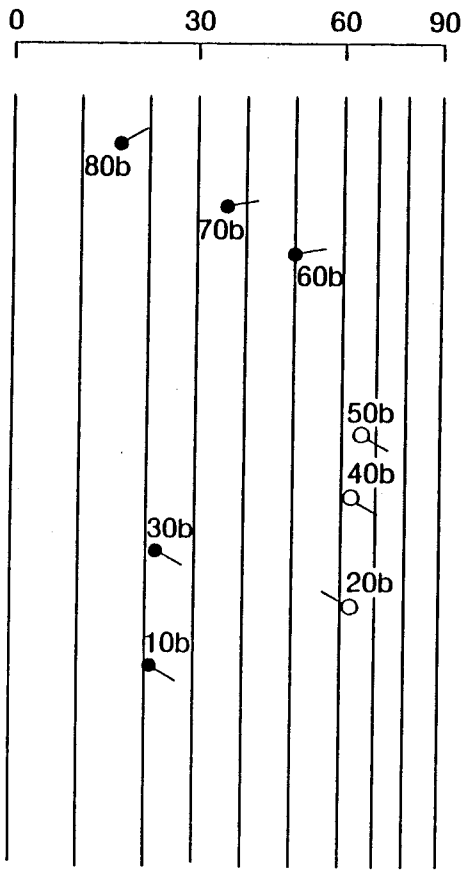
Figure 2A:
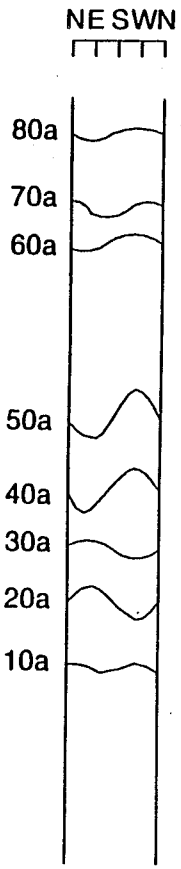

Referring now to FIG. 2, reference numerals 10*a*, 10*b*, 10*c* in FIGS. 2A, 2B, and 2C, respectively, correspond to 10*d*; 20*a*, 20*b*, 20*c* correspond to 20*d*; and similarly for the other numerals.

Referring now in detail to FIG. 2D, there is illustrated subterranean structure intersecting a borehole 2. The subterranean structure includes bedding planes 10*d*, 30*d*, 60*d*, 70*d*, and 80*d* and fracture planes 20*d*, 40*d*, and 50*d*. Fault planes 40*d* and 50*d* are conjugate to fracture plane 20*d*. Fracture planes 40*d* and 50*d* also show movement and hence are faults.

Each of the bedding planes and fracture planes can be characterized by depth, dip angle, and dip direction. FIG. 2C illustrates how the bedding planes and fracture planes might appear in oriented core removed from the borehole. The diameter of the oriented core has been enlarged for purposes of illustration.

The dip angle and dip direction of bedding and fracture planes can also be shown in a "tadpole plot" (conventionally used in displaying results of dipmeter logging) such as FIG. 2B in which the tadpoles have heads located at vertical positions representative of depth, at horizontal positions representative of dip angle as shown at the top of the record, and have tails representative of dip direction relative to north shown by the amount of clockwise rotation of the tail from an upward position representative of north. Thus, record 2B is representative of depth, dip angle, and dip direction of the bedding planes and fractures.

Different symbols can be used to represent fractures and bedding planes, for example, the heads of the tadpoles can be closed for bedding planes and open for fractures. Fractures can be distinguished from bedding planes on borehole televiewer records because fractures occur at dip angles and directions departing from the prevailing trend set by the bedding planes, generally occur at higher dip angles than the bedding planes, cut across the bedding planes, and the like. In addition, fractures which are faults can be recognized by the rubble zone or gouge zone or distortion zone associated therewith. Such identifications of individual planar formation features as faults, fractures, and bedding planes from borehole televiewer records are known to those skilled in televiewer interpretation and need not be further described here.

A visual record of the borehole surface as it might be observed in a typical borehole televiewer record is shown schematically in FIG. 2A. The visual record of FIG. 2A if rolled into a cylinder and aligned with north would have signals 10*a*, 10*b*, and so forth corresponding to planes 10*c*, 20*c*, and so forth of the oriented core illustrated in FIG. 2C.

According to the invention, there is a method for identifying conjugate fracture systems in brittle or semi-brittle formation materials comprising scanning a record representative of generally planar subsurface features intersecting a borehole, the record being representative of depth, dip angle, and dip direction of the generally planar subsurface features. The record representative of depth, dip angle, and dip direction is preferably a record produced from pulse-echo acoustic (borehole televiewer) logging of the borehole since such records display directly bedding planes, faults, and fractures intersecting the borehole. Also, records representative of depth, dip angle, and dip direction such as FIG. 2B can be prepared from pulse-echo acoustic logging records as discussed below. Also, such records can be composed from, for example, dipmeter derived data representative of bedding planes, and records such as pulse echo acoustic logging records or other sources representative of depth, dip angle, and dip direction of fractures and faults intersecting a borehole.

Dip angle and dip direction relative to the borehole of generally planar formation features intersecting a borehole can be measured from a record representative of the borehole surface produced by pulse echo acoustic logging. Dip angle and dip direction relative to the borehole is herein referred to as apparent dip angle and apparent dip direction to distinguish them from true dip angle and dip direction relative to the surface of the earth and to geographic north respectively. Apparent values can be converted to true values by an appropriate transformation as discussed below.

The record can be either an amplitude or traveltime based record, either of which can be produced as is well known to those skilled in the art. Preferably, both amplitude and traveltime records are used for this and other steps of the invention. Such records are illustrated schematically in FIG. 2A.

Referring now to FIG. 2A, it can be seen that generally planar formation structures intersecting a borehole are represented by sinusoidal patterns on the borehole televiewer record.

Dipping planar formation structures can be recognized by the characteristic sinusoidal curves on both amplitude and traveltime-based records. The apparent dip angles (angle $\theta$ from the horizontal plane perpendicular to the borehole) can be determined as $Tan^{-1}$ h/D where "h" is determined by measuring the height (difference in depths along the borehole) of a sinusoidal pattern from peak to trough from a televiewer record such as 2A and "D" is the borehole diameter of the borehole being surveyed. The apparent dip direction can be determined by measuring or "picking" the direction (azimuth) relative to north of the trough (negative peak) of a sinusoidal pattern. Since the trough of a sinusoidal pattern represents the low point of an intersection of a fracture or bedding plane with the borehole, the azimuth of the trough is the apparent dip direction or apparent azimuth.

A display or record summarizing the measurements made in the previous steps can be used in practicing the invention. Such a record is illustrated by FIG. 2B.

Thus, a record of apparent dip angle and apparent dip direction can be generated for a portion of a borehole being evaluated. The apparent dip angle and apparent dip direction can be generated from any suitable source of information, for example, from dipmeter logs, borehole televiewer logs, and the like. According to a preferred embodiment, the record of dip angle and dip direction are generated from borehole televiewer logs since a particularly advantageous result can then be accomplished allowing the identification of fractures and faults not identifiable from available dipmeter data. Further, generating such records from borehole televiewer logs means that dipmeter logs need not be available for the well being evaluated, and/or that high quality dipmeter logs need not be available for the well being evaluated.

The record of dip angle and dip direction can be any suitable record of dip angle and direction over the formation of interest, for example, "tadpole" plots of dip angle and direction which could be laid along side borehole televiewer logs, as illustrated in FIGS. 2A and 2B, or computerized records of dip angle and direction which can be printed out. In either event, a separate record of dip angle and dip direction can be generated as shown in FIG. 2B.

A step of locating a set of generally planar formation structures which are representative of fractures is a feature of the invention. The set of generally planar formation structures representative of fractures can be identified by using a record such as FIG. 2B or by using both traveltime and amplitude-based borehole televiewer records such as is illustrated by FIG. 2A alone or in combination.

Referring to FIG. 2B, it can be seen that faults and fractures 20*d*, 40*d*, and 50*d* have dip angles significantly deviating from the dip angles of planar structures 10*d*, 30*d*, 60*d*, 70*d*, and 80*d*. The dip of such bedding planes is sometimes referred to as a prevailing trend since such bedding planes are typically more numerous than the planes of fracture. Thus, a set of fracture planes can be recognized by departure from the prevailing trend.

Thus, referring to FIG. 1B, it can be seen that 20*d*, 40*d*, and 50*d* have dips in the range of 60°–70° from horizontal, whereas the bedding planes of the prevailing trend have dips in the range of 15°–50° from horizontal.

Referring now to FIG. 3, it can be seen that the fault plane of normal faults and reverse faults have different characteristic dip angles, i.e., about 65° for normal faults and about 25° for reverse faults. Thus, fractures 20*d*, 40*d*, and 50*d* have apparent dips characteristic of fractures associated with normal faults. The fact that fractures 20*d*, 40*d*, and 50*d* have about equal dip angles and have dip directions about 180° apart indicates that the borehole is penetrating the formation about parallel to the maximum principal stress direction $\sigma_1$ responsible for the fracture system. This is because the included angle $\psi$ opposite the borehole is about 130°, hence the acute angle formed between fracture planes is bisected by a line about parallel to the borehole. Although faulting has occurred in the illustrated fracture system, normal conjugate fractures where faulting has not occurred showing a similar angular pattern.

The characterization of planar structures 20*d*, 40*d*, and 50*d* as fault-related fractures can be confirmed by reference to a borehole televiewer record such as illustrated schematically in FIG. 2A.

Faults resulting from displacement of geological structure along a fault plane can produce an image on the borehole televiewer log similar to the images produced by other fractures and bedding planes, but are in addition characterized by distortion zones or gouge zones. Distortion or gouge zones, sometimes referred to as rubble zones, are zones associated with shear fractures resulting from movement of blocks of rock adjacent the faults relative to one another. Such movement results in abrasion, crumbling, and the like of the adjacent blocks giving rise to the distortion or rubble zone. Such distortion zones or gouge zones or rubble zones associated with fault planes can be identified using interpretation techniques developed for the identification of open or partially open fractures on borehole televiewer records. Specifically, the response of a distortion zone or gouge zone associated with a fault can be similar to the response of a partially open fracture.

A partially open fracture can be identified by comparing amplitude-based logs with traveltime-based logs from the borehole televiewer. An open fracture can produce an image on the amplitude-based log because little or no signal is reflected to the logging sonde; and a filled fracture can produce an image on the amplitude-based log where there is sufficient acoustic contrast between the filling material in the fracture and the host material to produce a reflected signal. Thus, the amplitude-based log is relatively insensitive to whether a particular fracture is open or filled.

By way of contrast, the traveltime-based log can be indicative of whether a particular fracture is open or filled. By assigning an identifiable visible parameter on the traveltime-based log, for example, the color black, to failure or absence of a return reflection, an identifiable (for example, black) image can be produced when no signal is returned. Thus, an image of a fracture on an amplitude-based log plus an image on the traveltime-based log can indicate an open fracture. An image on the amplitude-based log and no image on the traveltime based log can then indicate a closed fracture. Where there is a fracture image on the amplitude-based log, but there is a no return indication (for example, black) on at least part of the corresponding interval of the traveltime log, the fault can be interpreted as partially open (partially filled). If the image on the traveltime-based log indicates an uneven or rugose surface, the zone can be interpreted as a distortion or gouge zone and can be the most conspicuous feature in a portion of the borehole televiewer log.

A gouge zone or distortion zone can thus be used to identify shear faults where the gouge or distortion zone can be identified to exist in a fault-related fracture system. In fault related fracture systems, the fault can be considered the larger feature of the stress field that caused all of the fractures. In brittle or semibrittle isotropic rock such as shown in FIGS. 1A and 3A, where the principal stress is vertical, the resulting normal faults will dip at about 65° from horizontal, broadly in the range of about 45° to about 75°. Where the principal stress $\sigma_1$ is horizontal, such as shown in FIGS. 1B and 3B, the resulting reverse fault will dip at about 25° from horizontal, broadly in the range from about 15 to about 35°. Angles outside of these ranges can also occur. However, angles formed in a conjugate fracture system by intersections of conjugate fractures will have angles about equal to one another and generally will form angles assignable to the 130° and 50° pattern described above. These two aspects can be used to identify conjugate fracture systems in the subsurface. For example, if two fractures are identified as having an included angle $\psi$ or a supplementary angle $\psi$ equal to about 50° or about 130°, this is an indication that conjugate fractures are involved. Further, if two or more pairs of fractures are identified having intersections of about equal angles, even though these angles are not assignable to the 50° or 130° pattern, this is also an indication of conjugate fractures. These two aspects are cumulative and can be of course used together.

According to a feature of the invention, a set of fractures is located having a first and second subset of fractures having about equal dip angles and having dip directions about 180° apart Referring to FIG. 2, fractures 20*d*, 40*d*, and 50*d* have about equal dip angles - see FIG. 2B. Consequently, fractures 20*a*, 40*a*, and 50*a* are representative of a set of fractures having about equal dip angles. Further, fracture 20*d* has a dip direction about 180° from the dip direction of fractures 40*d* and 50*d*—see FIG. 2B. Consequently, fracture 20*d* is a first set of fractures and fractures 40*d* and 50*d* are a second set of fractures, these sets having about equal dip angles and having dip directions about 180° apart. Thus, fractures 20*d*, 40*d* and 50*d* meet the criteria for a fault-trelated fractures parallel to a fault and fractures conjugate to the fault.

Identification of such fault-related fracture systems has greater reliability when the faults and conjugate fractures occur in a limited portion of the borehole record. Further, paleostresses can vary with depth along the borehole. Preferably, therefore, evaluation of conjugate fracture systems in accordance with the invention will be conducted within a zone of less than about 200 ft depth, or even less than about 50 ft depth. Longer zones can also, of course, be so evaluated. Particularly reliable results can be obtained where a fault-related system occurs within a zone of less than about 200 ft depth, or even less than about 50 ft depth.

The dip direction can be used to distinguish fractures parallel to the fault from fractures conjugate to the fault.

Generally, the fractures parallel to the fault will be more numerous than fractures conjugate to the fault and will dip in "opposite" directions (in the ideal case about 180° apart). The dip angle and dip direction of fractures parallel to the fault thus provides a measure of the dip angle and dip direction of the fault. The most conspicuous fracture on the borehole televiewer record of the set of fault-related fracture systems can be identified as the normal fault itself. Where both amplitudebased and traveltime-based logs are utilized, the fault having an associated gouge zone or distortion zone, which shows as a partially open fracture based on comparison of the amplitude-based logs and the traveltime-based logs can be identified as the normal fault.

The dip of bedding planes in the vicinity of a fault-related fracture system can also be determined and used in support of an interpretation. An increase in dip angle with depth of bedding planes followed by a decrease in dip angle with depth of bedding planes is an indication of a drag zone adjacent a fault and can be used to confirm the indication of a fault.

According to a feature of the invention, directions of paleostresses selected from the group consisting of maximum principal stress $\sigma_1$, intermediate principal stress $\sigma_2$, and minimum principal stress $\sigma_3$, can be determined from a set of fault-related fractures comprising fractures parallel to the fault and fractures conjugate to the fault.

Referring now to FIG. 3, FIG. 3 illustrates the relationships of maximum, intermediate, and minimum principal stress directions to normal and reverse faults.

Thus, for a normal fault as shown in 3A, the maximum stress direction is vertical and bisects the angle formed by the fault and by a reflection or conjugate fracture to the fault, i.e., forms an angle of about 25° with the fault. The intermediate principal stress $\sigma_2$ is perpendicular to $\sigma_1$ and parallel to the fault. The minimum principal stress $\sigma_3$ is perpendicular to each of $\sigma_1$ and $\sigma_2$.

For a reverse fault as shown in 3B, the maximum principal stress direction $\sigma_1$ is horizontal and forms an angle of about 25° with the fault. $\sigma_2$ and $\sigma_3$ can be defined in reference to $\sigma_1$ as described for FIG. 3A.

The borehole televiewer is a pulse echo sonic wave logging tool which can be used to produce a visual representation of a borehole wall. A planar structure intersecting a borehole is represented by an image that appears as a sine wave when a circular borehole is "unwrapped." Knowing the radius of the borehole, one can find the orientation of the planar structure in borehole coordinates, that is, relative to the borehole, from the sine wave. This is known as the apparent orientation. The true orientation can be found by transforming from borehole coordinates to earth coordinates.

A. INTRODUCTION

Equation Representative of a Planar Structure

Figure 4:
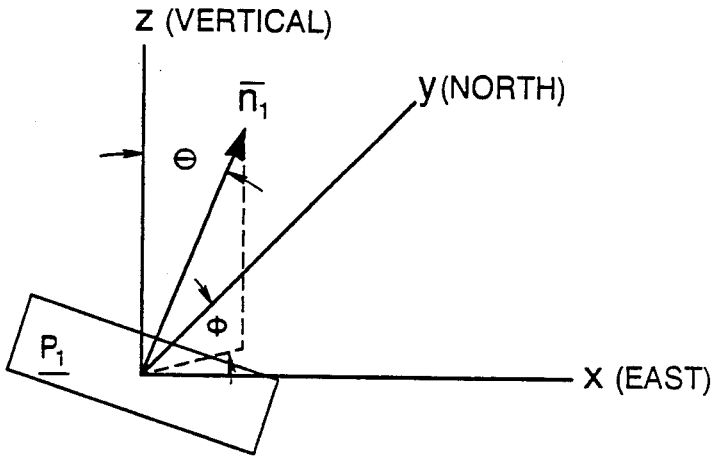
FIG. 4 illustrates the relationship of a normal vector to a plane in a selected coordinate system.

Consider the axis system as diagrammed in FIG. 4. The y-axis is oriented north and the x-axis east. $\phi$ is azimuth measured clockwise from north and $\theta$ is the declination or dip from the vertical axis z. Let $P_1$ be a plane passing through the origin with normal vector $$\vec{n}_1=(\sin\theta_1\sin\phi_1,\ \sin\theta_1\cos\phi_1,\ \cos\theta_1)^t \quad (1)$$

Superscript t indicates the transpose operation.

The equation of $P_1$ is the inner product $$\vec{n}_1{}^t\vec{x}=0 \quad (1A)$$

where $\vec{x}$ is the column vector $(x,y,z)^t$.

Equation Representative of a Borehole Centerline

Let $L_1$ be a line with direction vector $$\vec{n}=(\sin\theta_3\sin\phi_3,\ \sin\theta_3\cos\phi_3,\ \cos\theta_3)^t$$

passing through the origin. $L_1$ is defined by the parametric vector equation $$\vec{x}=s\vec{n}_3,\ -\infty<s<\infty$$

Equation Representative of a Borehole

Let $C_1$ be a cylinder of radius r centered around $L_1$. $C_1$ is defined by the vector equation $$\vec{x}=s\vec{n_3}+r\vec{m} \quad -\infty<s<\infty$$

where $\vec{m}$ is a unit vector perpendicular to n, i.e., $\vec{m}^t\vec{m}=1$ and $\vec{m}^t\vec{n_3}=0$.

Intersection of a Planar Structure and a Borehole

The intersection of $P_1$ and $C_1$ is given by the set of equations $$\vec{n_1}^t\vec{x}=0 \tag{2}$$

$$\vec{x}=s\vec{n_3}+r\vec{m} \quad -\infty<s<\infty \tag{3}$$

$$\vec{m}^t\vec{m}=1 \tag{4}$$

$$\vec{m}^t\vec{n_3}=0 \tag{5}$$

Rotation from Earth Coordinates to Borehole Coordinates

The above intersection of $P_1$ and $C_1$ is given in terms of earth coordinates, but televiewer data is commonly presented in borehole coordinates. The following matrix transformation takes earth coordinates to borehole coordinates. Borehole coordinates (x',y',z') are aligned so the vertical z' axis is coincident with the borehole centerline. The defining transformation is $$\vec{x'}=R_1^{-1}R_2R_1\vec{x} \tag{6}$$

where $$R_1 = \begin{matrix} c_{\theta 3} & -s_{\theta 3} & 0 \\ s_{\theta 3} & c_{\theta 3} & 0, \\ 0 & 0 & 1 \end{matrix} \quad R_2 = \begin{matrix} 1 & 0 & 0 \\ 0 & c_{\theta 3} & -s_{\theta 3} \\ 0 & s_{\theta 3} & c_{\theta 3} \end{matrix}$$

The notation $^c\phi_3$, $^s\phi_3$, etc., means $\cos\phi_3$, $\sin\phi_3$, etc. $R_1$ and $R_2$ are orthogonal matrices, i.e., $R_1^{-1}=R_1^t$ and their product $R=R_1^{-1}R_2R_1$ is also orthogonal. R has elements $\{r_{11}, r_{12}, r_{13}, \text{etc.}\}$. Therefore, earth coordinates are given in terms of borehole coordinates by $$\vec{x}=R^t\vec{x'} \tag{7}$$

which is obtained from Eq. (6) by multiplying it by $R^{-1}=R^t$.

Vector Perpendicular to Borehole Centerline

In borehole coordinates (x',y',z'), a unit column vector of the form $(s_\alpha,c_\alpha,0)^t$ will be perpendicular to the boreof hole centerline because the centerline has direction (0,0,1). Therefore, in earth coordinates, this vector is $R^t(s_\alpha,c_\alpha,0)^t$ using Eq. (7). This vector can be taken as m since it is a unit vector and is perpendicular to the borehole centerline. Thus, we take $$\vec{m}=R^t\,(s_\alpha,c_\alpha,0)^t \tag{8}$$

Intersection of Borehole and Planar Structure in Borehole Coordinates

Equations (2) and (3) are transformed to borehole coordinates by applying Eq. (7). We have $$0=\vec{n_1}^t\vec{x}=\vec{n_1}^tR_1^t\vec{x'} \tag{9}$$

for $L_1$ and $$R^t\vec{x'}=s\vec{n_3}+r\vec{m} \tag{10}$$

for $C_1$. Multiplying (10) by R, we get $$\vec{x'}=sR\vec{n_3}+rR\vec{m} \tag{11}$$

$R\vec{n_3}$ is the unit vector $(0,0,1)^t$ and $R\vec{m}$ is the unit vector $(s_\alpha,c_\alpha,0)^t$ in borehole coordinates. Equation (11), therefore, simplifies to $$\vec{x'}=(rs_\alpha,rc_\alpha,s)^t. \tag{12}$$

The intersection of $L_1$ and $C_1$ in borehole coordinates is given by substituting (12) in (9). We get $$0=\vec{n_1}^tR^t(rs_\alpha,rc_\alpha,s)^t \tag{13}$$

The only variables in this equation are $\alpha$ and s. Solving (13) for s, we get $$s=-r\left(\frac{a}{c}s_\alpha+\frac{b}{c}c_\alpha\right) \tag{14}$$

where $$(a,b,c)=\vec{n_1}^tR^t=(Rn_1)^t \tag{15}$$

Equation (14) shows s is a sinusoidal function of $\alpha$; in other words, the intersection of the planar structure and borehole is a sine wave on the borehole wall. Equation (14) is the ideal borehole televiewer response curve for detecting plane $P_1$. Equation (15) shows the coefficients of (14) come from the orientation of the bedding plane transformed to borehole coordinates.

Orientation of Planar Structure $\vec{n_1}$,i.e., $\theta_1$ and $\phi_1$ can be determined from values of s and $\alpha$ satisfying (14) knowing $r,\theta_3$, and $\phi_3$. (14) shows the ratios a/c and b/c can be determined which involve inner products of trigonometric functions of $\theta_1,\phi_1,\theta_3$, and $\phi_3$ which are defined by (15). The two ratios give two equations in $\theta_1$ and $\phi_1$, which can be solved as follows:

Now $\alpha$ is the angle described as the borehole is encircled around its centerline. It is zero on the y' axis and increases clockwise to the x' axis looking down on the positive z' axis. Borehole televiewer data are given so that $\alpha=0$ corresponds to north in the earth axis coordinate system. To achieve an $\alpha$ with this property, an angle $\beta$ must be determined in borehole coordinates which puts a vector in an x'y' plane parallel to the yz plane. Eq. (7) can be used to do this. Let $(s_\beta,c_\beta,0)^t$ be a unit vector in borehole coordinates, then it is perpendicular to the borehole centerline. In addition, the unit vector should have no easterly component in earth coordinates so $$(O,y,z)^t=R^t\,(s_\beta,c_\beta,0)^t \tag{16}$$

is the condition it must satisfy. (16) reduces to the following equation in $\beta$ $$0 = r_{11}s_\beta + r_{21}c_\beta \tag{17}$$

$$\text{which is } t_\beta = \frac{-r_{21}}{r_{11}}$$

$$\text{or } \beta = \tan^{-1}\frac{-r_{21}}{r_{11}}$$

Substituting $r_{11} = c_{\phi 23} + c_{\Theta 3}s_{\phi 23}$, $r_{21} = -s_{\phi 3}\,c_{\phi 3} + c_{\Theta 3}s_{\Theta 3}c_{\Theta 3}$, we find $$\beta = \tan^{-1}\frac{t_{\phi 3}\,(1 - c_{\Theta 3})}{1 + t^2_{\phi 3}c_{\Theta 3}}.$$

Therefore, if $\alpha$ in (14) is replaced with $\alpha+\beta$, then when $\alpha=0$, the modified (14) gives the borehole televiewer response of the bedding plane from the north.

B. Transformation to Earth Coordinates

It is customary in examination of borehole televiewer records for one to give the $\alpha^*$ that is the angle one sees from televiewer data when the sinusoidal curve representative of a planar structure is at a minimum vertical deflection. The minimum deflection is denoted by s* and is negative and is determine from the borehole televiewer record. Therefore, for the simple case of a vertical borehole, $\alpha^*$ is the azimuth of the bedding plane and the dip $\rho=\tan^{-1}(-s^*/r)$. For a nonvertical borehole $\alpha^*$ is the apparent dip direction or azimuth defined above and $\rho$ is the apparent dip angle defined above. Apparent dip angle and apparent dip direction can be converted to true dip angle and true dip direction as follows.

The normal vector, say $\vec{n}'$, of the bedding plane in borehole coordinates is $$\vec{n}'=(\sin\tau\,\sin(\alpha^*+\beta),\ \sin\tau\,\cos(\alpha^*+\beta),\ \cos\tau)^t \tag{18}$$

To find its representation in earth coordinates, we use (7) getting $$n=\overrightarrow{R^t n'} \tag{19}$$

and from (1) we see true dip is calculated as $$\theta_1=\cos^{-1}n_3 \tag{20}$$

and true azimuth as $$\theta_1=\tan\,(n_1/n_2) \tag{21}$$

where $\vec{n}=(n_1,n_2,n_3)^t$.

Therefore, the method of solution to determine the orientation of $P_1$ is to find the apparent dip $\tau$ and apparent azimuth $\alpha^*$ in borehole coordinates and transform these to earth coordinates by equations (18)–(21). The earth coordinates will be true earth coordinates if magnetic declination is further taken into consideration in the usual way.

A listing for a program to perform this transformation is provided below. It will be seen that all that is required is a measure of apparent azimuth $\alpha^*(\alpha^*)$ and minimum deflection s*(s star) from the borehole televiewer record to determine $\theta_1$ and $\phi_1$ for a planar formation structure. By using the thus determined $(\theta,\phi)$, the normal for the planar structure can be determined from Equation (1). The program is written in MATLAB marketed by The MathWorks, Inc., Sherborn, Mass. It will be apparent that other programs can be readily prepared by those skilled in the art from the present disclosure.

```
theta3=input('theta3?'); phi3=input('phi3?');
theta3=theta3*pi/180.; phi3=phi3*pi/180.;
ct3=cos(theta3); st3=sin(theta3); cp3=cos(phi3);
sp3=sin(phi3);
R1=[cp3 sp3 0; -sp3 cp3 0; 0 0 1]
R2=[1 0 0; 0 ct3 -st3; 0 st3 ct3]
R3=[cp3 -sp3 0; sp3 cp3 0; 0 0 1]
R=R1*R2*R3
radius=input('radius?');
alphastar=input('alphastar?');
azapp=alphastar*pi/180.;
sstar=input('sstar?');
dipapp=atan(-sstar/radius);
appaz=alphastar;
appdip=dipapp*180./pi;
azapp=azapp+beta;
n=[sin(dipapp)*sin(azapp)sin(dipapp)*cos(azapp)cos(-
  dipapp)];
v=R'*n';
truedip=acos(v(3))*180./pi;
trueaz=atan(v(1)/v(2))*180./pi;
if v(2)<0;
trueaz=trueaz+180;
end
```

C. Indication of Conjugate Fractures

The inverse calculation described here to determine a planar structure orientation can be used to find conjugate fractures. A conjugate fracture is indicated when the angle between the normals of two fractures is roughly 50° or 130°. Alternatively, if the included angle opposite the borehole, or its supplementary angle, measured between two or more pairs of fractures intersecting the borehole is about equal, a conjugate fracture system is indicated. Thus, to determine if two fractures are part of a conjugate fracture system, one can obtain their orientations by the calculation described above, and calculate the angle between their normals. The angle between the normals can be given by the dot product of the two normals:

$$\Omega=\arccos\,(\vec{n_1}\cdot\vec{n_2}) \tag{22}$$

wherein $n_1$ and $n_2$ are the normals to the two fractures given in either apparent or true values - see Eq. (1). Whether $\Omega$ is acute or obtuse is given directly by (22) or can be determined by inspection of the apparent or true orientation angles of the fracture planes.

D. Directions of Formation Stresses

The direction of the maximum principal stress $\sigma_1$ is given by the direction of the line bisecting the acute angle represented by $\psi$ or its supplementary angle.

The direction of the intermediate principal stress $\sigma_2$ is parallel to the direction of the line formed by the intersection of two conjugate fractures. This line can be readily determined by solving Eq. (1A) of two conjugate fracture planes for their common solutions.

The direction of the minimum principal stress $\sigma_3$ is determined as perpendicular to each of $\sigma_1$ and $\sigma_2$.

The invention will be further understood and appreciated from the following Examples:

EXAMPLE I

In a north Louisiana well, a record of dip angle and dip direction such as illustrated by FIG. 2B was constructed using borehole televiewer log data. A zone having dip angles from 45° to 75° was identified between 1550 and 1575 ft in depth, indicating a possible faulted interval. From the record, six (6) parallel fractures with dip directions to the northeast were identified, indicating the dip direction of the possible fault plane. A fracture at 1565 ft had an opposite direction and was identified as conjugate to the fault plane. The fracture at 1557 ft, one of the six (6) parallel fractures, was the most conspicuous of all of the fractures in this interval, and was identified as the fault plane. The included angle $\Omega$ opposite the borehole is about 130°. Therefore, a normal fault is indicated with the maximum principal stress $\sigma_1$ direction parallel the borehole; the intermediate principal stress $\sigma_2$ is parallel to the direction of the line of intersection of the conjugate fractures, that is, along the northwest-southeast direction line; and the minimum principal stress is perpendicular to $\sigma_1$ and $\sigma_2$, that is, along the northeast-southwest line.

EXAMPLE II

In a Gulf of Suez well, a record such as illustrated in FIG. 2B was constructed from borehole televiewer data. A group of fractures with dips from 45° to 74° was located in the interval from 11,425 ft in depth to 11,500 ft in depth, indicating a possible faulted interval. Five (5) parallel fractures were observed with dip directions dipping to the southwest, indicating the dip direction of a possible fault plane. A fracture dipping in the opposite direction, i.e., to the northeast, was also identified as conjugate to the fault plane. The interval between the fractures and 11,437 ft which appeared from examination of the borehole televiewer amplitude-based and the traveltime-based log records to be a gouge zone is identified as the fault plane. The included angle $\psi$ opposite the borehole is about 130° and therefore a normal fault is indicated with the maximum principal stress $\sigma_1$ direction parallel the borehole; the intermediate principal stress $\sigma_2$ direction parallel to the direction of the line of intersection of the conjugate fractures, that is, along the northwest-southeast direction line; and the minimum principal stress perpendicular to $\sigma_1$ and $\sigma_2$, that is, along the northeast-southwest direction line.

For the same well, dipmeter data did not indicate the presence of a fault between 11,435 and 11,437 ft.

The Examples illustrate determining the directions of maximum, intermediate, and minimum principal stress directions from borehole televiewer records.

It will be apparent that there has been provided a method for identifying and characterizing conjugate fracture systems in subterranean formations. Knowledge of such conjugate fracture systems and of the directions of such fracture systems can be of key importance in producing a reservoir. There has also been provided a method for determining the in-situ stress state causing conjugate fracture systems which is of fundamental significance with regard to fractures induced, for example, hydraulically, in subterranean formations.

Thus, the general configuration of propagating hydraulic fractures is generally dependent upon the insitu stress state. Since most subsurface hydraulically induced fractures are more or less oriented in the vertical plane, the relative magnitudes and directional components of the principal stresses in the horizontal plane greatly influence the azimuthal direction in which fractures will propagate. Consequently, the ability to predict the directional components of the principal stresses in the generally horizontal plane in the subsurface is of great importance in the production of a reservoir.

This information is particularly important in low permeability formations where deeply penetrating fractures with low fracture lengths are required for economic development of a formation. In these cases, the knowledge of the direction in which the fractures will propagate is a critical factor in well spacing, pattern and placement. If the wells are not placed in a pattern consistent with the directions in which the induced fractures will propagate, a poorly patterned well system can result and can cause significant reduction in well productivity and total recovery from the formation. The ability to predict the direction of propagation of induced fractures is also a critical issue in waterflooding and enhanced recovery operations. Here, the direction in which fractures will propagate in relation to a particular well pattern can have a significant effect on the areal sweep efficiency of the enhanced recovery operation. In accordance with the invention, a method is provided for determining formation stresses in subterranean formations which provides highly significant information for the design of well spacing, pattern and placement.

While the invention has been illustrated and described in certain and specific aspects, the invention is not so limited but by the claims appended hereto construed in accordance with established principles of law.

What is claimed is:

1. A method for identifying fault-related fracture systems in subterranean formation materials adjacent a borehole comprising:

scanning a record representative of depth, dip angle, and dip direction of generally planar subsurface features intersecting a borehole;

locating a set of fractures and deriving a measure of dip angle $\theta$ and dip direction $\phi$ for each fracture of the set producing a set of measures $(\theta,\phi)$;

selecting a first subset and second subset of fractures each subset characterized by a different $(\theta,\phi)$; and determining an indicator of whether the selected first subset and second subset fractures are conjugate by deriving a measure of one of the included angle $\psi$ opposite the borehole formed by intersection of a first subset fracture and a second subset fracture and the supplementary angle of $\psi$.

2. The method of claim 1 wherein the set of fractures comprises fractures having about equal dip angles, and the step of deriving the measure comprises determining that the set of fractures comprises first and second subsets of fractures having dip angles about 180° apart relative to the borehole, and using the sum of dip angles $\theta$ of a first subset fracture and of a second subset fracture as a measure of included angle $\psi$.

3. The method of claim 1 further comprising:

comparing the measure with measures predicted by conjugate fracture systems and assigning the first subset fractures and second subset fractures to a type of conjugate fracture system having a measure about equal to the measured characteristic of the intersections of the first subset fractures and the second subset fractures.

4. The Method of claim 1 further comprising:

determining the direction of action relative to formation penetrated by the borehole of at least one paleostress selected from the group consisting of the maximum principal stress $\sigma_1$, the intermediate principal stress $\sigma_2$, and the minimum principal stress $\sigma_3$.

5. The method of claim 4 wherein:

the step of determining the direction of action comprises determining such direction of action relative to the borehole and then transforming such direction of action in earth coordinates.

6. The Method of claim 1 wherein the step of scanning comprises:

measuring dip angle and dip direction of generally planar formation structures intersecting a borehole, the generally planar formation structures comprising at least bedding planes, fractures, and faults, and the dip angles and dip directions being measured from a record representative of the borehole surface produced from pulse-echo acoustic logging, and producing from the resulting measurements a synthetic record of formations adjacent the borehole, the synthetic record representing at least depth, dip angle, and dip direction of generally planar formation features intersecting the borehole.

7. The Method of claim 6 further comprising:

representing fractures by a first symbol and bedding planes by a second symbol on the synthetic record.

8. The Method of claim 1 further comprising:

selecting a fault-related fracture zone by determining a region of the borehole record characterized by first subset fractures and second subset fractures having a measure representative of included angles representative of normal conjugate fracture systems.

9. The Method of claim 8 further comprising:

selecting a fault-related fracture system by determining a region of the borehole record characterized by first subset fractures and second subset fractures having a measure representative of reverse conjugate fracture systems.

10. The Method of claim 1:

wherein the step of locating comprises locating the set of fractures within less than about 200 ft of depth along the borehole.

11. The Method of claim 1 wherein:

the step of locating comprises locating the set of fractures within less than about 50 ft of depth along the borehole.

* * * * *

UNITED STATES PATENT AND TRADEMARK OFFICE

CERTIFICATE OF CORRECTION

PATENT NO. : 4,781,062

DATED : November 1, 1988

INVENTOR(S) : Thompson J. Taylor

It is certified that error appears in the above—identified patent and that said Letters Patent is hereby corrected as shown below:

In Column 11, lines 39 and 40,"faul -trelated" should read --fault-related--.

In Column 11, line 65, "amplitudebased" should read --amplitude-based--.

In Column 13, line 8, "n" should read --$\vec{n}$--.

In Column 13, line 40, "c Θ3 -s Θ3" should read -- $c\phi_3$ $-s\phi_3$--.

In Column 13, line 42, "$R_1$ = s Θ3 c Θ3" should read -- $R_1 = s\,\phi_3\ c\,\phi_3$--.

In Column 13, line 60, "boreof hole" should read --borehole--.

In Column 13, line 64, "m" should read -- $\vec{m}$ --.

In Column 15, line 31, "ρ = tan" should read -- τ = tan--.

In Column 15, line 33, "ρ " should read --τ --.

In Column 15, line 44, "n" should read -- $\vec{n}$ --.

In Column 15, line 52, "Θ1" should read --$\phi_1$ --.

UNITED STATES PATENT AND TRADEMARK OFFICE

CERTIFICATE OF CORRECTION

PATENT NO. : 4,781,062

DATED : November 1, 1988

INVENTOR(S) : Thompson J. Taylor

It is certified that error appears in the above-identified patent and that said Letters Patent is hereby corrected as shown below:

In Column 16, lines 48 and 52, "Ω" should read --ψ--.

In Column 17, line 16, "Ω" should read --ψ--.

Signed and Sealed this

Seventh Day of May, 1991

*Attest:*

*Attesting Officer*

HARRY F. MANBECK, JR.

*Commissioner of Patents and Trademarks*